US005159766A

United States Patent [19]

Henig

[11] Patent Number: 5,159,766

[45] Date of Patent: Nov. 3, 1992

[54] APPARATUS FOR DRYING GALVANIZED MASS-PRODUCED PARTS

[76] Inventor: Hans Henig, Albrecht-Achilles-Strasse 48, 8500, Nürnberg, Fed. Rep. of Germany

[21] Appl. No.: 669,068

[22] Filed: Mar. 12, 1991

[51] Int. Cl.[5] ..... F26B 21/06

[52] U.S. Cl. ..... 34/77; 34/34; 34/133 J; 118/418

[58] Field of Search ..... 34/130, 131, 133 R, 34/73, 76, 77, 78, 133 J, 133 M, 34, 63, 133 L, 133 N, 133 P, 133 Q; 118/418

[56] References Cited

U.S. PATENT DOCUMENTS

| | | | |
|---|---|---|---|
| 2,676,418 | 4/1954 | Shewmon | 34/77 |
| 2,910,783 | 11/1959 | Hoyt | 34/77 |
| 3,831,294 | 8/1974 | Freze | 34/77 |
| 3,905,122 | 9/1975 | Ohshima et al. | 34/60 |
| 4,204.339 | 5/1980 | Muller | 34/77 |
| 4,287,672 | 9/1981 | Henig | 34/77 |
| 4,447,965 | 5/1984 | Bray | 34/77 |
| 4,483,160 | 11/1984 | Jost | 34/77 |
| 4,785,759 | 11/1988 | Motoyama et al. | 34/133 |

*Primary Examiner*—Henry A. Bennett

*Assistant Examiner*—Denise L. F. Gromada

*Attorney, Agent, or Firm*—Jacobson, Price, Holman & Stern

[57] ABSTRACT

Apparatus for drying galvanized mass-produced parts (3) in an immersion-type perforated (30) drum (1) includes a container (2) having a cavity for accommodating the drum, and a chamber for guiding a stream of drying-air (22) which passes through the drum (1) and charge (3) of mass-produced parts, the chamber being divided into two separated regions one of which is upstream of the drum of guiding the stream of dry air (22) to the drum, and the other of which is downstream of the drum for guiding the stream of humid air from the drum. The flow region for the humid air stream forms an approximately V-shaped flow path, whereby an angle of < 90° is formed between the entry direction of the humid air stream in one leg (ABSR) of the V-shaped and the exit direction of the humid air stream in the other leg (CDVT) of the V. Baffles (9) are provided in the flow stream to direct the flow and scoops (5) aid in removing moisture from the downstream air, the arrangement of parts being designed to increase the effectiveness of such drying apparatuses, both quantitatively and qualitatively.

11 Claims, 2 Drawing Sheets $\beta = 59^{\circ} < 90^{\circ}$

APPARATUS FOR DRYING GALVANIZED MASS-PRODUCED PARTS

This application relates to U.S. patent applications Ser. Nos. 07/486,376 filed Feb. 28, 1990 and 07/064,988 filed Aug. 9, 1979, now U.S. Pat. No. 4,287,672.

BACKGROUND OF THE INVENTION

The invention relates to an apparatus for drying galvanized mass-produced parts disposed in an immersion-type drum which drum is rotatable around its horizontal longitudinal axis and has a perforated shell. More particularly, the invention is in an apparatus comprised of a container having a cavity for accommodating the drum, and a chamber for guiding a stream of drying-air which passes through the charge of mass-produced parts and is produced by suction or blowing action of a blower, wherein the chamber is divided into two separated regions one of which is upstream of the drum and is intended to guide the stream of dry air, and the other of which is downstream of the drum and is intended to guide the stream of humid air.

Such drying apparatuses are known, from German Patents Nos. 2,803,117; 2,836,183; and 3,029,520. They serve to dry charges of pourable mass-produced parts in an immersion drum following final electrochemical or chemical surface treatment and final rinsing. In such drying in the same drum previously used for the surface treatment, a number of process-specific features which occur simultaneously must be taken into account, particularly the following two processes which at least partially overlap:

1. The drawing along and entrainment of the liquid drops of various sizes adhering to the surfaces of the mass-produced parts by the stream of drying-air incident on the surfaces as air passes through the immersion-type drum and through the charge; and 2. The evaporation of the residual liquid film on the surface of the mass-produced parts under the action of the stream of drying-air which has been heated to about 60° C. and is passing over the surfaces of the mass-produced parts.

The first above phenomenon should be given highest priority in the drying. If the predominant phenomenon in the drying is the second listed above, undesirable spotting will occur on the surfaces of the mass-produced parts.

The spotting is comprised primarily of residues of mineral salts from the rinse water which salts are dissolved in the liquid film and which solidify as a consequence of the drying. To minimize such spotting, the speed of the entrainment of the liquid droplets adhering to the surfaces of the mass-produced parts must be maximized, and at the same time the evaporation must be minimized. This necessitates that the stream of drying-air pass through the charge at maximum speed. In order to be able to generate such a stream, sources of resistance in the flow path should be avoided.

As a rule, the stream of drying-air which passes through the perforated shell of the drum and through the charge is passed in a circulating loop. A precondition of this is that the liquid droplets which are entrained from the surfaces of the mass-produced parts be removed from the air stream and from the flow path of the stream, so that the droplets cannot be returned to the charge which is undergoing drying. In German Patent No. 2,803,117 there is no discussion of the removal of moisture from the stream of drying-air. In the dryer according to German Patent No. 2,836,183 moisture is removed by a drop separator which the humid air stream reaches through a lengthy path. Because no appreciable moisture removal occurs on the path, the moisture removal must occur practically exclusively in the drop separator. Consequently, the separator must be large and must impose a substantial pressure drop on the stream of drying-air.

In the dryer according to German patent No. 3,029,520 a draining pan is disposed below the immersion-type drum. The intention is that liquid droplets entrained in the stream of drying-air will be removed with the aid of this pan. However, the removal is imperfect. The humid air stream which leaves the drum in an essentially vertical downward direction passes across the middle of the draining pan, and therefore most of the drops contained in the stream are passed to the blower where they are swirled into a fine mist and are passed backed to the charge. Also the draining pan imposes substantial flow resistance which results in appreciable reduction of the flow speed and prolongation of the time to accomplish the drying. As mentioned above, low flow speed and long drying times both promote evaporation of the liquid adhering to the surfaces of the mass-produced parts, thereby promoting spotting. Also, long drying times lead to appreciable mechanical stressing in the drum which is rotating during the drying, and thereby lead to damage to readily damaged surface coatings, e.g. the surfaces of galvanized mass-produced parts, which surfaces often have been passivated.

BRIEF SUMMARY OF THE INVENTION

An object of the present invention is to increase the effectiveness of known drying apparatuses, both quantitatively and qualitatively, namely by shorter drying times as a consequence of higher speed of the stream of drying-air passing through the charge, and by more rapid and maximally complete removal of the liquid droplets from the circulating stream of drying-air.

Starting with the known drying apparatus described supra, this problem is solved according to the invention in that the region downstream of the immersion-type drum forms an approximately U-shaped flow path, wherein an angle of $<90°$ is formed between the entry axis of the humid air stream in one leg of the V and the exit axis of the humid air stream in the other leg of the V.

The V-shape of the flow path subjects the humid air stream to a continuous strong change of direction. In practice, the air flows along the inner side of the outer wall of the flow path, which wall has a continuously curved configuration, and the air is pressed against the wall at a suitably high flow speed, wherein the liquid droplets contained in the air stream are separated out of it by virtue of their own weight and the centrifugal forces which develop. The droplets are consolidated on the inner side of the outer wall, and while flowing in the direction of the stream are collected at the bottom of the container which bottom forms a drain pan. The collected liquid is passed to the exterior via a drain.

The separation effectiveness of the V-shaped region depends on the size and density of the liquid droplets which are to be separated out, and most importantly also depends on the configuration of the flow path. The separation effectiveness is close to 100% for a spectrum of droplet sizes the lower limit of which is about 10 micron. Because of the V-shape of the flow path, which is compatible with good flow, the pressure loss suffered is low. The humid air stream flows in laminar flow with continuous change of direction, along the continuously curved inner side of the outer wall of this path. With mean stream speed of 5 m/sec, the pressure drop is about 60 mm water. In this connection, it has been found to be particularly advantageous if (according to an additional feature of the invention) the entry axis is inclined downward and outward, and the exit axis is oriented approximately horizontally.

The separation of droplets from the humid air stream should be effective over the entire spectrum of droplet sizes, including the smallest droplets verging on mist size. Toward this end, according to the invention a plurality of profiled elements, or scoops, are provided in the middle and lower outer wall region of the flow path and may be mounted on the inner side of the wall of container, such as by welding for example. These elements are separated by spaces, and disposed approximately transversely to the direction of flow. Advantageously, these are curved against the direction of flow, and have pass-through openings at their bases. When the droplets contained in the humid air stream impinge on these profiled elements, even very fine droplets are captured and collected. The fine droplets first aggregate into larger droplets and then flow along the inner side of the outer wall of the flow path, driven by the air stream, to be collected at the bottom of the container and finally to be withdrawn to the exterior. The shape of the profiled elements, which shape provides favorable flow conditions, and uniform distribution of the elements over the flow path, result in minimal pressure loss.

The separation of so-called aerosols from the humid air stream is of particular importance. An "aerosol" is understood to comprise colloidally distributed liquid particles with diameters below 10 micron and down to about 2 micron. To meet this requirement, according to the invention a drop separator in the form of a profiled grid system is interposed in the path of the humid air stream, upstream of the blower. Such separators have planar wall-like surfaces disposed transversely to the direction of flow. The humid air stream passing through the separator is repeatedly redirected as it impinges on the profiled grid system, whereby the droplets contained in the air stream separate out on the profiled grid elements, following which droplets are passed out of the separator and out of the container.

When the particle size distribution of the droplets has a particularly high proportion of very small liquid particles, according to an advantageous feature of the invention the separation may be intensified by providing an aerosol separator comprised of plastic fibers upstream of the drop separator. In such an aerosol separator the separation-out of the very small droplets is also accomplished via impingement, whereby the very small droplets are retained by the tightly arrayed fabric of plastic fibers and consolidate into larger droplets which then flow off and are separated out in the drop separator disposed downstream of the aerosol separator. In this way the moisture in the humid air stream exiting the immersion-type drum is completely removed, so that the air input to the blower is dry.

According to an advantageous refinement of the invention the flow path is redirected in a lower corner region of the container which container has a prismatic shape, so that the blower, which forms the end of the flow path, is disposed in the opposite corner region of the container. In this way, the height of the drying apparatus is kept low, making it easy to accommodate the apparatus within an installation for surface treatment of mass-produced parts and to mount the apparatus on the floor or base of the operational space. In addition, by disposing the blower (which preferably comprises a radial blower) in a lower corner region of the container, the blower readily serves to deflect the air stream by about 90° from the horizontal to the vertical direction and thereby essentially to meet the preconditions for laminar flow of the circulating drying-air. The substantial freedom from turbulence of the air stream enables higher flow speeds to be achieved, which affords the following important advantages:

a) Shorter drying times for the charge in the drum;
b) Drying of the electrolytically or chemically treated surfaces of the mass-produced parts without spotting, as a result of rapid fluid-mechanical removal of the residues of rinse water which adhere to the surfaces; and
c) Improved removal of liquid droplets and aerosols contained in the humid air stream, due to impingement and concentration of the droplets and aerosols on the inner side(s) of the outer wall of the flow path and in the separators.

It has been found to be advantageous, according to a further feature of the invention, to provide at least one baffle plate in the middle and lower region of the flow path, which plate has a curved configuration similar to that of the outer wall region and which plate is disposed approximately parallel to the wall region. The function of such baffle(s) is to guide the air stream, which still contains some moisture, such that the stream flows in laminar flow and is well distributed over the entire cross section of the lower leg of the flow path leading to the separator(s).

According to a preferred exemplary embodiment of the invention the flow path has a rectangular shape in the cross sectional planes transverse to the axes of the legs of the path, with the longitudinal sides of the rectangles being parallel to the rotational axis of the immersion-type drum. This configuration provides a compact structure for the drying apparatus wherein the outer wall of the flow path can simultaneously form at least part of the container wall.

According to additional advantageous features of the invention, curved plates are mounted at the entry end of the respective walls of the flow path, which plates partially enclose the shell of the immersion-type drum and serve as sealing elements which slide against the shell of the drum. The curved plates form a basin of approximately semicylindrical shape which is interrupted in its lower region by the entry opening leading to the region downstream of the drum. The immersion-type drum is partially enclosed by this basin. The drying-air flowing through the charge draws along and entrains the drops of liquid adhering to the surfaces of the mass-produced parts, and emerges through the perforated shell of the drum and the opening between the curved plates, to enter the flow path of the region downstream of the drum.

The configuration just described is particularly recommended for a so-called suction drum dryer. This is to be understood as an apparatus wherein the drying-air passing through the immersion-type drum and through the charge disposed in the drum is driven by means of an underpressure (vacuum) established outside of and generally below the drum. Where the stream of drying-air is driven by an overpressure which is established in the interior space of the drum which space is not occupied by the charge, the dryer is a pressure drum dryer.

BRIEF DESCRIPTION OF THE DRAWINGS

Two preferred exemplary embodiments of the invention will now be described in detail with reference to the accompanying drawings wherein.

DETAILED DESCRIPTION

Figure 1:
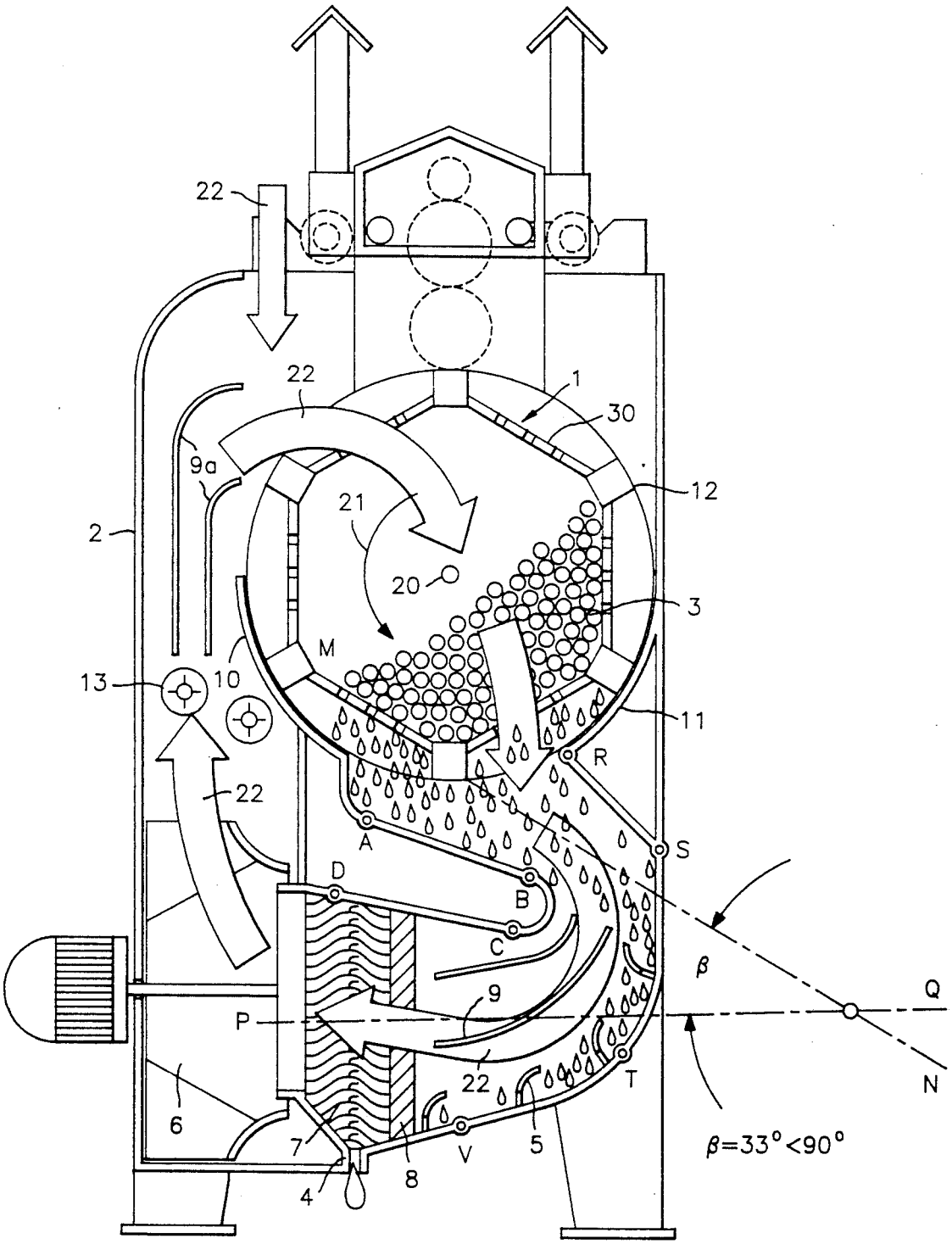
FIG. 1 is a schematic cross-sectional view of a suction-type drum dryer in accordance with the invention.

Both exemplary embodiments shown comprise an immersion-type drum generally indicated at 1, the perforated shell 30 of which has a cross-sectional shape in the form of a regular hexagon. The drum 1 is rotatably mounted in the upper region of a container 2 which has an approximately prismatic shape. Drum 1 can be inserted in container 2 through an opening from above, and can be oriented therein from above. A charge 3 of galvanized mass-produced parts is contained in drum 1. The direction of rotation of immersion-type drum 1 around its longitudinal axis 20 is indicated by arrow 21; in FIG. 1 the direction is counterclockwise, and in FIG. 2 it is clockwise.

Container 2 has, in addition to the space for accommodating the immersion-type drum 1, a chamber for passing therethrough a stream of drying-air, indicated by the fat arrows 22 drawn in outline. This chamber is divided into two separate regions, one of which (on the left in the figures) is upstream of the drum 1 and is intended for passing the dry air. The other region (on the lower right in the figures) is downstream of the drum 1 and is intended for passing the stream of humid air. Between these two regions the stream of drying-air takes the following path: it first passes through the perforated shell 30 of the drum 1 and into the interior space thereof containing the charge 3; in FIG. 1 this passage of the drying-air is from above into the empty region of the interior space; and in FIG. 2 it is from below into the region of the interior space. The drying-air then passes through the charge 3 and leaves the interior space of the drum 1 through the perforated shell of the drum in the direction of the downstream region of the flow path. This downstream region is bounded by an inner wall ABCD and an outer wall RSTV, which walls are configured such that the flow path has a substantially V-shape, whereby the axes MN and PQ of the respective legs of the V-shape AB-RS and CD-TV form an angle of deflection, beta, which is $<90°$; namely, in FIG. 1 beta$=33°$, and in FIG. 2 beta$=59°$. The legs AB-RS, directed downwardly, and CD-TV, directed approximately horizontally, have rectangular cross sections the longitudinal sides of which are parallel to the rotational axis of the drum 1.

The exterior wall RSTV ends in an exit port 4, and has mounted thereon, such as by welding for example, a plurality of profiled elements or scoops 5 separated by spaces, and disposed approximately transversely to the direction of flow. These elements are curved against the direction of flow, i.e. have concave surfaces facing opposite to the direction of flow, and have openings at their bases through which the flow passes in part. A blower 6 is disposed at the end of the flow path. Blower 6 produces the air circulation with a suction action in the case of FIG. 1, and with a blowing action in the case of FIG. 2. A droplet separator 7 (FIGS. 1 and 2) is disposed upstream of the blower, and in the case of FIG. 1 an aerosol separator 8 as well. Baffles 9 are disposed in the middle and lower regions of the flow path to direct and distribute the humid air stream over the entire flow cross section. These baffles are curved similarly to the outer wall region STV and are disposed approximately parallel to wall region STV in the FIG. 1 embodiment. Similar baffles 9*a* may be disposed in the region of the flow path upstream of the drum 1.

At the upper end of the inner wall ABCD and the outer wall RSTV, curved plates 10 and 11 are disposed in the exemplary embodiment of FIG. 1. Plates 10 and 11 form a basin for accommodating the drum 1; they surround the lower half of drum 1 except for an entry opening 32 into the flow path ABCD-RSTV. Corner vanes 12 of the drum shell glide along the interior side of plates 10 and 11. The interaction of the plates 10 and 11 with the vanes 12 and the blower 6 produces a vacuum in the flow path ABCD-RSTV which is otherwise sealed airtight, which vacuum advances the stream of drying-air through the interior space of the drum 1 and the charge 3 disposed in drum 1. The plates 10 and 11 also act to advantageously guide the dry air stream above and into the drum 1.

Figure 2:
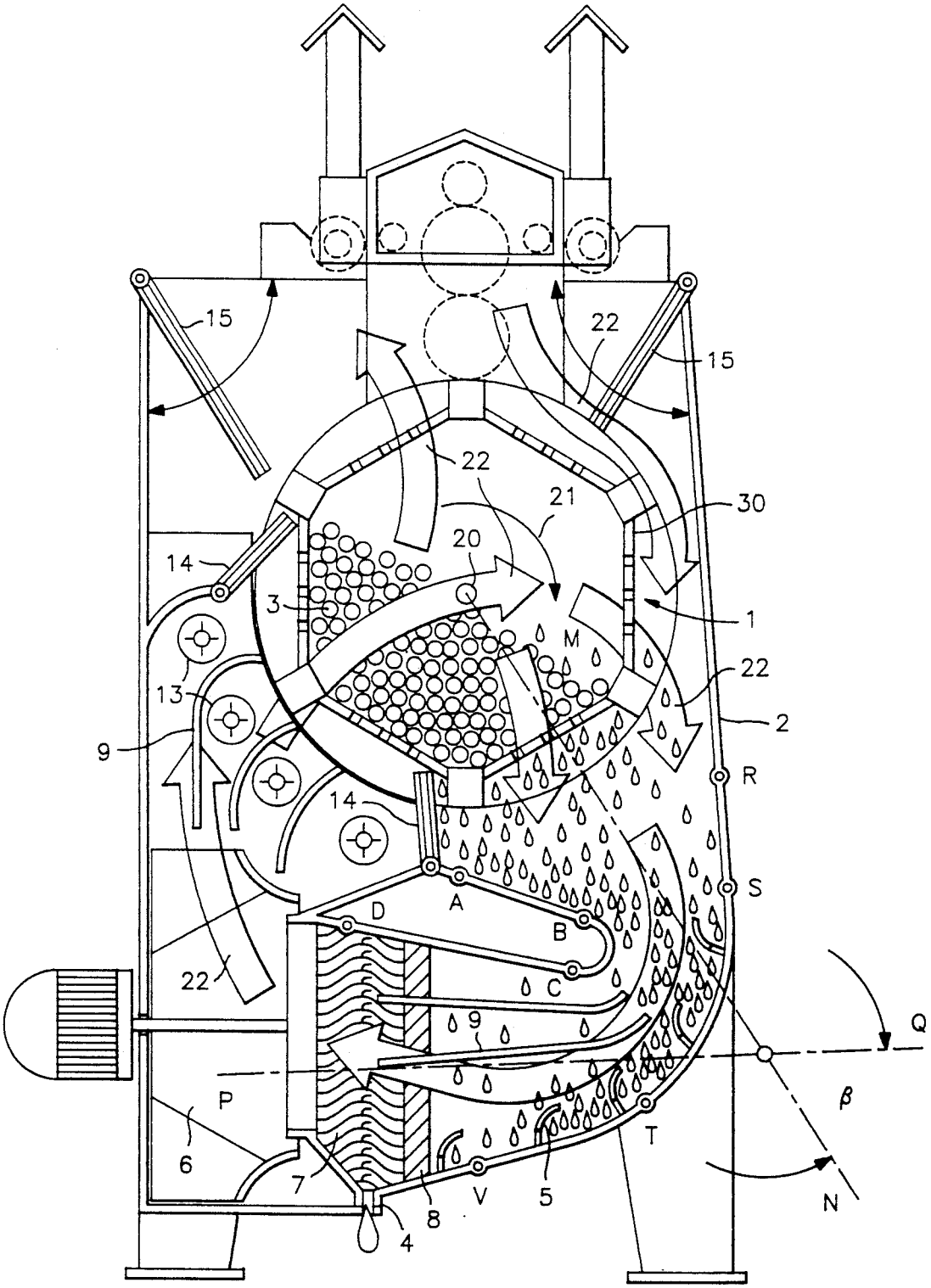
FIG. 2 is a schematic cross-sectional view of a pressure-type drum dryer of the invention.

Plates such as 10 and 11 are absent in the exemplary embodiment shown in FIG. 2. Here the region of the flow path upstream of the drum 1 is sealed airtight by sealing strips 14 which bear lamellar members or brushes and have longitudinal directions and/or axes extending parallel to the rotational axis 20 of drum 1 over the entire length of the drum. The dry air stream is blown from below through the perforated shell of drum 1 and through charge 3 into the free interior space of drum 1, whereby a part of the air stream flows downward along the inclined peripheral surface of the charge 3, so that a substantial number of the mass-produced parts in this region are well dried. From there the humid air stream passes out through the perforated shell of drum 1 into the flow path ABCD-RSTV. Adjustable dampers 15 may be employed to completely close off the otherwise open container 2 during the drying process, thereby ensuring loss-free circulation of the drying-air.

Heating registers 13 are provided in the region of the flow path which is upstream of drum 1. These heat the dry air stream, thereby assisting in accelerating the drying process. Otherwise, it would not be practicable to circulate the drying-air constantly in a full or partial loop through the apparatus; however, the air could be used in single-pass fashion.

The inventive apparatus is particularly suitable for complete or partial separation of liquid which adheres to the charge 3 and the immersion-type drum 1. If this liquid comprises rinse water (generally from the last, thorough rinsing of the sealed surface treatment), one expects complete drying. If, however, the adhering liquid comprises a treating solution which has adhered to the surfaces which it contacted, and the desire now is to recover it, but not necessarily completely, only the liquid adhering in the form of relatively large droplets is removed from the charge 3 and the drum 1. An example of such a situation is that of electrolyte from a zinc bath which electrolyte adheres to the charge 3 and immersion drum 1 and which it is sought to partially recover.

An immersion drum 1 having a length of 900 mm and a width of one side of 300 mm, and having 3 mm perforations, was loaded with a charge 3 of mass-produced parts having a total surface area of 4 square meters. The amount of adhering electrolyte upon removal from the bath was 1.5L. It was desired that the surface of the charge 3 remain wet. When treated according to the invention, only 60% of the adhering electrolyte, viz. 0.9L, was removed by suction and/or blowing. This electrolyte was pumped back directly into the zinc bath.

I claim:

1. An apparatus for drying work loads of parts in bulk contained in an immersion-type drum removably insertable into the apparatus, said drum being in the shape of a longitudinal cylindrical perforated shell and rotatable around a horizontal longitudinal axis thereof comprising:

a container;

a drum in said container having a horizontal longitudinal axis and a perforated shell, and mounted for rotation about said longitudinal axis;

a drying chamber in said container for guiding a stream of air through said drum and a charge of work load parts therein;

blower means in said chamber having an inlet and an outlet;

an upstream region in said chamber disposed upstream of said drum, with respect to the direction of flow of said air, between said outlet of said blower means and said drum for guiding a stream of dry air to and into said drum through said perforated shell;

a downstream duct region in said chamber disposed downstream of said drum between said drum and said inlet of said blower means for guiding a stream of humid air from said drum to said blower means and removing liquid droplets from said stream of air;

said downstream duct region forming a substantially V-shaped flow path having an entry leg portion extending from a position adjacent said drum and an exit leg portion extending to a position adjacent said inlet of said blower means, said entry and exit leg portions having substantially central axes extending at an angle of $<90°$ with respect to each other, said exit leg portion axis being oriented substantially horizontally and said entry leg portion axis being inclined downwardly between said drum and the bottom of the V of said V-shaped flow path; and curved plate members mounted in said container so that portions of said shell of said drum are in sliding and substantially sealing engagement therewith, said curved plate members partially enclosing said drum and being connected to said entry leg portion.

2. An apparatus as claimed in claim 1 and further comprising:

a plurality of curved scoop elements in at least part of said flow path extending in a substantially transverse relationship therewith for collecting droplets in said stream of air.

3. An apparatus as claimed in claim 2 wherein:

said V-shaped flow path has an outer wall region formed by part of said container; and said curved scoop elements have base portions connected to said outer wall region.

4. An apparatus as claimed in claim 3 wherein:

said curved scoop elements comprise curved concave surfaces facing oppositely to the direction of flow; and through openings are provided in said base portions.

5. An apparatus as claimed in claim 1 and further comprising:

a profiled drop separator grid system mounted in said flow path downstream of said drum for separating drops from said stream of air.

6. An apparatus as claimed in claim 5 wherein:

said drop separator is disposed upstream, with respect to the direction of flow, of said blower means.

7. An apparatus as claimed in claim 5 and further comprising:

an aerosol separator comprised of plastic fibers disposed upstream of said drop separator.

8. An apparatus as claimed in claim 1 wherein:

said container has a prismatic shape with a first lower corner region; and the bend in said V-shaped flow path between said entry and exit leg portions is substantially in said first lower corner region of said container.

9. An apparatus as claimed in claim 8 wherein:

said container has a second lower corner region opposite to said first lower corner region; and said blower means forms the downstream end of said exit leg portion in said second lower corner region of said container.

10. An apparatus as claimed in claim 1 and further comprising:

an outer wall portion on said container forming an outer wall region of said V-shaped flow path; and at least one baffle plate in said flow path having a configuration similar to that of said outer wall region and extending substantially parallel to said outer wall region for guiding said stream of air.

11. An apparatus as claimed in claim 1 wherein:

said V-shaped flow path has a rectangular cross-sectional shape in planes transverse to said direction of flow through said leg portions formed at least partly by longitudinal sides extending substantially parallel to said rotational axis of said drum.

* * * * *